US005809951A

United States Patent [19]

Kim

[11] Patent Number: 5,809,951

[45] Date of Patent: Sep. 22, 1998

[54] APPARATUS FOR OPENING AND SHUTTING VALVES OF AN ENGINE

[75] Inventor: Jae-choon Kim, Seoul, Rep. of Korea

[73] Assignee: Kia Motors Corporation, Seoul, Rep. of Korea

[21] Appl. No.: 743,831

[22] Filed: Nov. 5, 1996

[30] Foreign Application Priority Data

Sep. 3, 1996 [KR] Rep. of Korea ..... 1996-38066

[51] Int. Cl.[6] ..... F01L 1/18; F01L 13/00

[52] U.S. Cl. ..... 123/90.16; 123/90.39

[58] Field of Search ..... 123/90.15, 90.16, 123/90.17, 90.39, 90.44; 74/522, 834

*Primary Examiner*—Weilun Lo

*Attorney, Agent, or Firm*—Van Cott, Bagley, Cornwall & McCarthy

[57] ABSTRACT

The present invention relates to an opening/shutting means for intake valves of a car includes a rocker arm shaft, a plurality of rocker arms having respectively slide holes through which the rocker arm shaft passes, one end part of the rocker arm opening/shutting the intake valves and the other end part of the rocker arm being in contact with a cam on a cam shaft, an oil chamber provided at least at one end part of the rocker arm shaft to receive oil therein through an oil inlet connected with a gallery hole of a cylinder head, and a balance spring provided in one part of the oil chamber to support the rocker arm shaft against the oil pressure, wherein the amount of intake gas is automatically controlled according to varying speeds by the lift degree of the rocker arm pivoting on the rocker arm shaft which reciprocates in the slide hole of the rocker arm according to the balance between the oil pressure and the elasticity of the balance spring, so that the fuel consumption is reduced and the optimum engine output and the idle stability are achieved.

6 Claims, 2 Drawing Sheets

APPARATUS FOR OPENING AND SHUTTING VALVES OF AN ENGINE

BACKGROUND OF THE INVENTION

1. The Field of the Invention

The present invention relates to an opening/shutting means for intake valves of a car which enables the amount of intake gas to be automatically controlled and improves fuel consumption and idle stability at varying speeds.

2. The Background Art

An engine comprises a plurality of intake valves and exhaust valves in a cylinder head. The intake valves and exhaust valves are opened or shut by the pivoting of rocker arms on a rocker arm shaft.

The rocker arms are located along the rocker arm shaft which is in parallel to a cam shaft. One end part of the rocker arm is in contact with the intake valve and the other end part is contact with a cam, so that the rocker arm pivots on the rocker arm shaft by the rotation of the cam, which is located on the cam shaft and rotates by power from cam pulleys.

Conventionally, the rocker arm shaft is fixed at one position in a plurality of the rocker arms. The degree of the opening of the intake valve, that is, the lift degree of the rocker arm by the cam is therefore constant regardless of engine performance requiring relatively small amount of intake gas at a low speed and relatively large amount of intake gas at a high speed. Therefore, the intake gas is oversupplied at a low speed causing the increase of harmful exhaust gas and the intake gas is undersupplied to combust sufficient fuel at a high speed causing the decrease of engine output. Further, the amount of the intake gas appropriate for idling is not supplied, so that the stability of engine performance is degraded and the amount of exhaust gas increases.

BRIEF SUMMARY AND OBJECTS OF THE INVENTION

The object of the present invention is, therefore, to provide an opening/shutting means for intake valves of a car which controls the amount of intake gas by adjusting the lift degree of a rocker arm according to varying speeds of the car, so that fuel consumption and harmful exhaust gas are reduced and idle stability is improved.

According to the present invention, the opening/shutting means for intake valves of a car comprises a rocker arm shaft, a plurality of rocker arms having respectively slide holes through which the rocker arm shaft passes, one end part of the rocker arm opening/shutting the intake valves and the other end part of the rocker arm being in contact with a cam on a cam shaft, an oil chamber provided at least at one end part of the rocker arm shaft to receive oil therein through an oil inlet connected with a gallery hole of a cylinder head, and a balance spring provided in one part of the oil chamber to support the rocker arm shaft against the oil pressure, wherein the position of the rocker arm shaft is variable by its reciprocation within the slide holes according to the balance between the oil pressure and the elasticity of the balance spring, and the lift degree of the rocker arm is variable by the position of the rocker arm shaft, thus controlling the opening degree of the intake valves.

BRIEF DESCRIPTION OF THE DRAWINGS

The invention will now be described by way of example with reference to the accompanying drawings, in which.

DETAILED DESCRIPTION OF THE PREFERRED EMBODIMENTS

Figure 1:
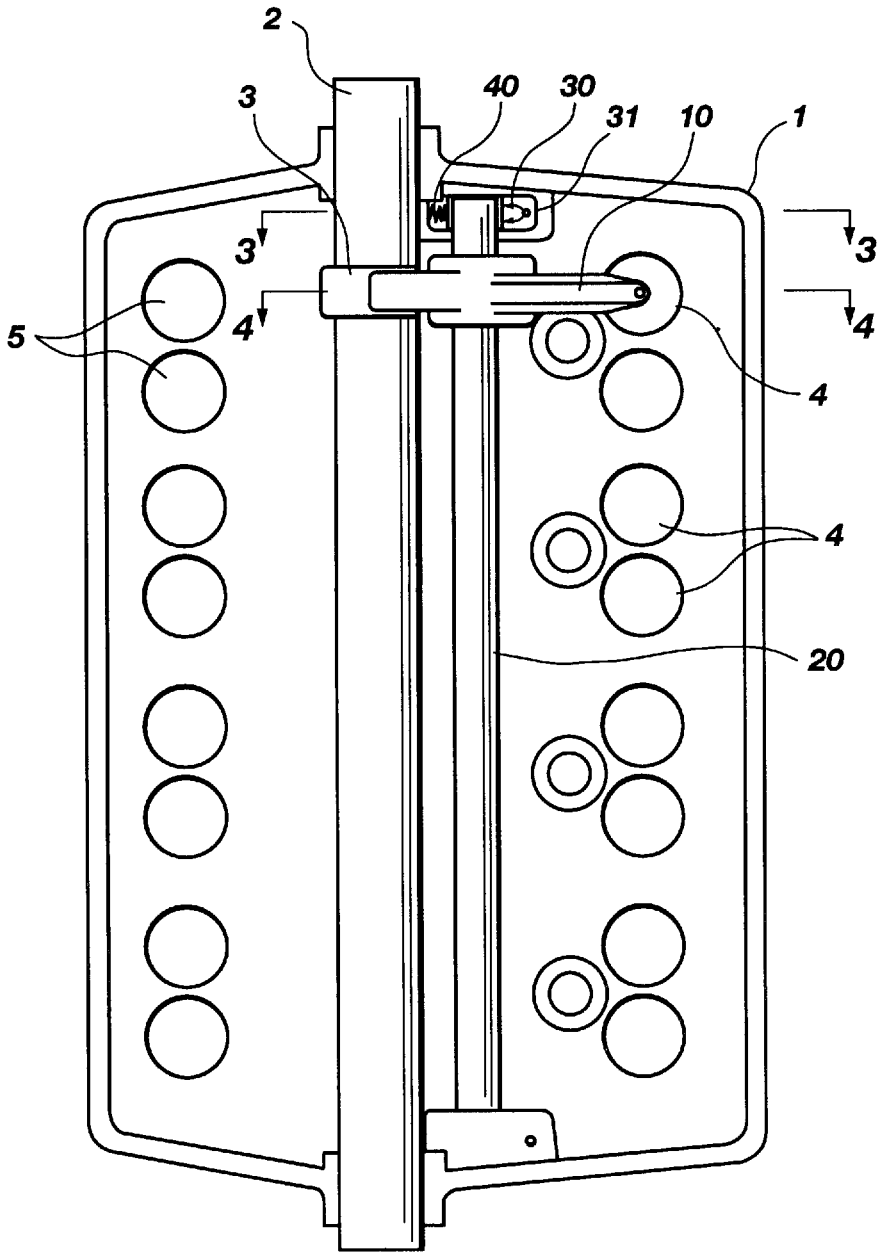
FIG. 1 is a schematic plane view showing a construction of a cylinder head containing a rocker arm and a rocker arm shaft according to the present invention.
Figure 2:
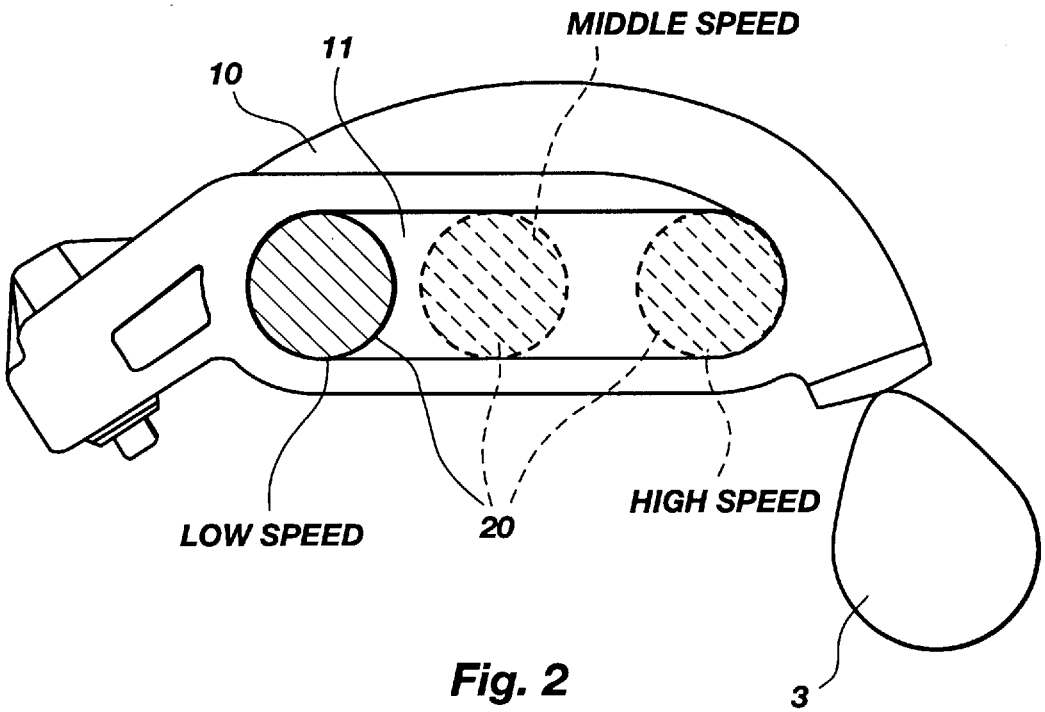
FIG. 2 is a partial sectional view taken along line A–A' of FIG. 1.
Figure 3:
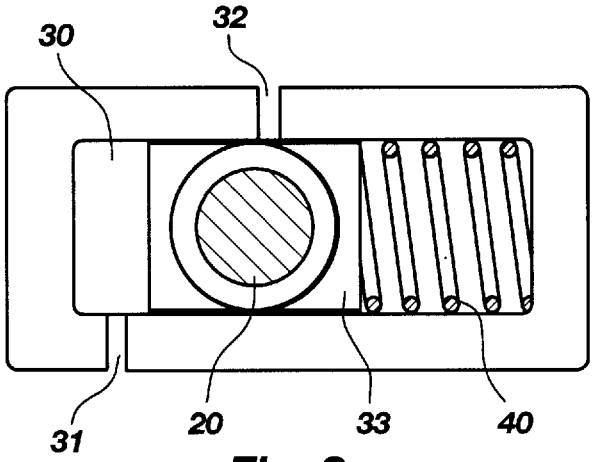
FIG. 3 is a partial sectional view taken along line B–B' of FIG. 1.

FIG. 1 shows a schematic plane view of a cylinder head containing an opening/shutting means of intake valves of the present invention. In FIG. 1, a rocker arm 10 is located on a rocker arm shaft 20 and its one end part is in contact with an intake valve 4. The other end part of the rocker arm 10 is in contact with a cam 3. The rocker arm 10 pivots on the rocker arm shaft 20 by rotary power of the cam 3 which rotates on a cam shaft 2 by power supply from cam pulleys and opens or shuts the intake valve 4 or an exhaust valve 5. In FIG. 2, a slide hole 11 is formed in the rocker arm 10 and the slide hole has an elongate inner part extending horizontally so that the rocker arm shaft 20 may slide left or right therein freely. The rocker arm shaft 20 is extended between oil chambers 30 in parallel with the cam shaft 2 as shown in FIG. 1. Referring to FIG. 3, each of the oil chambers 30 has an oil inlet 31 at one part thereof and the inlet 31 is connected with a gallery hole to which the oil of a predetermined pressure is supplied from an oil pump to lubricate the cylinder head 1.

Each of the oil chambers 30 also has a balance spring 40 at the other part thereof to support the rocker arm shaft 20 against the oil pressure. The rocker arm shaft 20 can reciprocate in the slide hole 11 of the rocker arm 10 according to the balance between the oil pressure of the oil inlet 31 and the elasticity of the spring balance 40.

In order to facilitate the reciprocation of the rocker arm shaft 20, a guide pin 33 is provided in each of the oil chambers 30 and the rocker arm shaft 20 is inserted into the guide pins 33 at its both end parts. The rocker arm shaft 20 reciprocates by means of the guide pins 33 in the slide hole 11. Referring to FIG. 2, at a low speed, the rocker arm shaft 20 moves to the left in the slide hole 11 as shown by a solid line, since the oil pressure applied to the oil inlet 31 from the gallery hole is lower than the elasticity of the balance spring 40. Therefore, even though the position of the rocker arm 10 lifted by the cam 3 is not changed by the movement of the rocker arm shaft 20, the lift degree of the rocker arm 10 by the pivoting of the cam 3 becomes relatively small since the rocker arm shaft 20 is positioned on the far left from the cam 3 and the rocker arm 10 pivots on the rocker arm shaft 20 adjacent to the intake valve 4. By the lifting of the rocker arm 10, the intake valve 4 is opened in an optimum state for a low speed.

On the other hand, at a high speed, the oil pressure applied to the oil hole 31 from the gallery hole is relatively larger than the elasticity of the balance spring 40 in the oil chamber 30. Therefore, the rocker arm shaft 20 moves to the right in the slide hole 11 as shown by a dotted line in FIG. 2. Even though the position of the rocker arm 10 lifted by the cam 3 is the same as in the above low speed, the lift degree of the rocker arm 10 by the pivoting of the cam 3 becomes relatively large since the rocker arm shaft 20 is positioned on the right near the cam 3 and the rocker arm 10 pivots on the rocker arm shaft 20 in the farthest position from the intake valve 4. As a result, the intake valve 4 is fully opened to supply sufficient amount of gas to the engine in the optimum state for a high speed, and the best engine output is achieved. Further, at a middle speed, the oil chamber 30 is kept the balance between the oil pressure and the elasticity of the balance spring 40. The rocker arm shaft 20 is positioned in the middle of the slide hole 11 in the rocker arm 10 as shown by the other dotted line in FIG. 2. In this case, the intake valve 4 is opened as in conventional engines.

Preferably, an oil outlet 32 is provided on the opposite side of the oil inlet 31 in the oil chamber 30 to discharge oversupplied oil. Further, the rocker arm shaft 20 and the guide pin 33 are preferably designed to be fixed to each other and not to move mutually, and the guide pin 33 and the oil chamber 30 are sealed together to prevent the leakage of oil.

According to the present invention, the amount of intake gas is automatically controlled according to varying speeds by the lift degree of the rocker arm pivoting on the rocker arm shaft which reciprocates in the slide hole of the rocker arm, so that the fuel consumption is reduced and the optimum engine output and the idle stability are achieved.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. Apparatus for opening and shutting valves of an engine, the apparatus comprising:

an elongate rocker arm shaft having a rocker arm shaft first end and a rocker arm shaft second end;

at least one rocker arm located on said rocker arm shaft between said rocker arm shaft first end and said rocker arm shaft second end, said rocker arm having a rocker arm first end and a rocker arm second end, said rocker arm first end being configured to be driven by a cam and said rocker arm second shaft being configured to cause an engine valve to open;

an elongate opening formed in said rocker arm between said rocker arm first end and said rocker arm second end, said rocker arm shaft being movably installed through said elongate opening;

a first rocker arm shaft reciprocating oil chamber located at said rocker arm shaft first end, and a second rocker arm shaft reciprocating oil chamber located at said rocker arm shaft second end, each of said first and second rocker arm shaft reciprocating oil chambers including an oil inlet and a balance spring, wherein a combination of oil pressure through said inlet and tension of said balance spring serve to slide said rocker arm shaft to different locations within said rocker arm elongate opening for different engine speeds in order to select a valve lift appropriate for the engine speed.

2. Apparatus as recited in claim 1 further comprising:

a guide pin located in each of said oil chambers;

wherein said guide pins are attached to said rocker arm shaft; and wherein said rocker arm shaft is moved to a desired position within said rocker arm opening in a reciprocating manner by oil pressure exerted on said guide pins in said oil chambers.

3. An apparatus as recited in claim 1 further comprising:

an oil outlet in each of said chambers, said oil outlet serving to discharge oversupplied oil.

4. Apparatus as recited in claim 1 wherein varying positioning of said rocker arm shaft within said elongate opening varies lift degree of a valve operated by said rocker arm.

5. Apparatus as recited in claim 4 wherein at a low engine speed, said oil chambers cause said rocker arm shaft to be located in a position within said rocker arm elongate opening in order to provide a first lift degree to a valve being opened by movement of said rocker arm; and wherein at a high engine speed, said oil chambers cause said rocker arm shaft to be located in a position within said rocker arm elongate opening in order to provide a second lift degree to a valve being opened by movement of said rocker arm, said second lift degree being greater than said first lift degree.

6. Apparatus for opening and shutting valves of an engine, the apparatus comprising:

an elongate rocker arm shaft;

at least one rocker arm located on said rocker arm, said rocker arm having a rocker arm first end and a rocker arm second end, said rocker arm first end being configured to be actuated by a cam and said rocker arm second shaft being configured to open an engine valve;

an elongate slot formed in said rocker arm between said rocker arm first end and said rocker arm second end, said rocker arm shaft projecting through said elongate slot;

a rocker arm shaft oil chamber, said oil chamber including an oil inlet through which oil is received in order to create oil pressure within said oil chamber and apply said oil pressure to said rocker arm shaft, an oil outlet through which excess oil may escape said oil chamber, and a balance spring which may exert tension on said rocker arm shaft in order to cause positioning of said rocker arm shaft to be determined by a balance of oil pressure and spring tension;

wherein said combination of oil pressure and spring tension serve to continuously and slidingly adjust rocker arm shaft position within said elongate slot in order to continuously select valve lift appropriate for engine speed.

* * * * *